US009315961B2

(12) United States Patent
Lancaster

(10) Patent No.: US 9,315,961 B2
(45) Date of Patent: Apr. 19, 2016

(54) SELF-ANCHORING TURF REINFORCEMENT MAT AND REUSABLE SEDIMENT FILTRATION MAT

(71) Applicant: North American Green, Inc., Alpharetta, GA (US)

(72) Inventor: Timothy L. Lancaster, Evansville, IN (US)

(73) Assignee: North American Green, Inc., Alpharetta, GA (US)

( * ) Notice: Subject to any disclaimer, the term of this patent is extended or adjusted under 35 U.S.C. 154(b) by 0 days.

(21) Appl. No.: 13/893,479

(22) Filed: May 14, 2013

(65) Prior Publication Data

US 2013/0309012 A1 Nov. 21, 2013

Related U.S. Application Data

(60) Provisional application No. 61/647,370, filed on May 15, 2012.

(51) Int. Cl.
*E02B 3/04* (2006.01)
*E02D 31/00* (2006.01)

(52) U.S. Cl.
CPC .. *E02B 3/04* (2013.01); *E02D 31/00* (2013.01)

(58) Field of Classification Search
CPC ..... E02D 17/20; E02D 29/025; E02D 3/00; E02D 31/002; E02D 5/80; E02D 31/00; E02D 3/005; E02B 3/04; E02B 3/12; E02B 11/00; E02B 3/14; E02B 3/122; A01G 13/0268; B09B 1/004; A63B 69/3661; E01C 13/02; E01C 13/08; E01C 9/08; E01C 9/086; E21F 15/04
USPC ..... 405/302.4, 302.6, 302.7, 15, 16, 19, 36, 405/284
See application file for complete search history.

(56) References Cited

U.S. PATENT DOCUMENTS 2,092,183 A * 9/1937 Rehfeld ..... E02B 3/124 405/19
3,315,408 A * 4/1967 Fisher ..... A01G 13/0268 405/16
3,586,624 A * 6/1971 Larson ..... B09B 1/00 210/170.07
3,795,180 A * 3/1974 Larsen ..... E01C 13/02 405/36

(Continued)

FOREIGN PATENT DOCUMENTS

KR 100972515 B1 7/2010

*Primary Examiner* — Benjamin Fiorello
*Assistant Examiner* — Edwin Toledo-Duran
(74) *Attorney, Agent, or Firm* — E. Eric Mills; Nexsen Pruet, PLLC

(57) ABSTRACT

A three dimensional high strength tightly woven turf reinforcement mat (TRM) or reusable sediment filtration mat designed to trap soil particles in water flow and provide a shear plane to prevent soil wash-out from within and beneath the mat. The mat includes a corrugated body structure integrally extruded or interwoven with a bottom layer that together form a plurality of parabolic sediment entrapment chambers. As sediment bed load moves with water flow into the woven structure, water flow forces sediment through openings in the woven surface of the corrugated body structure and into the chambers where the captured sediment serves as ballast to self-anchor the mat. The mat may also be incorporated during manufacture and/or during/after installation with polyacrylamides, chitosans or other soil flocculating/aggregating chemicals for increased sediment aggregation and capturing.

18 Claims, 6 Drawing Sheets

(56) References Cited

U.S. PATENT DOCUMENTS 3,888,197 A * 6/1975 Seith ..... A01C 1/044 111/200
4,002,034 A * 1/1977 Muhring ..... E02B 3/126 137/512.15
4,135,843 A * 1/1979 Umemoto ..... E02B 3/127 405/18
4,184,788 A * 1/1980 Colle ..... E02B 3/127 405/18
4,610,568 A * 9/1986 Koerner ..... E02D 17/202 405/15
4,690,585 A * 9/1987 Holmberg ..... E02B 3/127 405/15
5,039,250 A * 8/1991 Janz ..... E01F 7/02 256/12.5
5,404,671 A * 4/1995 Farrow, Jr. ..... A01C 1/046 405/302.4
5,651,641 A * 7/1997 Stephens ..... D04H 11/00 405/302.6
5,735,640 A * 4/1998 Meyer ..... E01C 3/003 404/70
5,849,645 A * 12/1998 Lancaster ..... E02B 3/04 405/15
6,422,787 B1 * 7/2002 Mikell ..... E02B 3/126 405/15
6,429,153 B1 * 8/2002 Welkers ..... B01D 39/083 405/302.7
6,779,946 B1 * 8/2004 Urriola ..... E01C 9/004 404/2
6,929,425 B1 * 8/2005 Kimberlin ..... C09K 17/52 405/302.4
7,029,208 B1 * 4/2006 Santha ..... E02B 3/125 405/15
2003/0082359 A1 * 5/2003 Scott ..... E01C 13/02 428/221
2005/0031803 A1 * 2/2005 Prevost ..... A01M 29/00 428/17
2005/0287343 A1 * 12/2005 Weiser ..... D03D 13/004 428/175
2006/0291963 A1 * 12/2006 Theisen ..... E02D 17/20 405/302.7
2007/0095747 A1 * 5/2007 Theisen ..... B01D 39/083 210/503
2012/0063854 A1 * 3/2012 Ayers ..... B09C 1/005 405/302.6
2012/0230777 A1 * 9/2012 Ayers ..... E02D 17/20 405/302.7

* cited by examiner

SELF-ANCHORING TURF REINFORCEMENT MAT AND REUSABLE SEDIMENT FILTRATION MAT

This application is based upon U.S. Provisional Application Ser. No. 61/647,370, filed May 15, 2012, and hereby claims the priority thereof to which it is entitled.

BACKGROUND OF THE INVENTION

1. Field of the Invention

The present invention is related to the field of matting used in environmental applications to establish and reinforce vegetative channel and slope linings and trap and retain sediment in water flow. More particularly, to a high strength turf reinforcement mat (TRM) having a tightly woven or extruded corrugated body structure that, without fiber infill, effectively filters, traps and retains sediment carried in a water flow, the sediment acting as ballast to create greater contact between the TRM and the underlying substrate. The mat may also be used as a reusable sediment filtration mat to trap and retain sediment in runoff water flowing from construction sites to prevent sediment deposition into nearby water bodies. The use of the mat in both of these applications may be in conjunction with soil flocculating chemicals such as polyacrylamides and chitosans which enhance aggregation of soil particles and expedite settling of soil particles out of water flow.

2. Description of the Related Art

Turf reinforcement mats (TRM's) are typically used with seeded vegetation and for permanent reinforcement of mature vegetation. Without reinforcement, vegetation relies primarily upon the root system of each plant to bond to the channel or slope surface. Grass lined channels and slopes possessing root systems reinforced with synthetic mats are capable of withstanding more than two times the flow velocities and double the flow durations of grass linings that are not reinforced.

One weakness of TRM's is the ineffectiveness of such products if the mats are not held in continuous intimate contact with the underlying soil surface. Gaps and spaces between the bottom of the TRM and the underlying soil collect water and are prone to erosion. Such gaps also inhibit vegetation propagation through the TRM, which negatively impacts the TRM's primary goal of establishing and reinforcing vegetative linings. To ensure continuous intimate contact with the underlying soil, TRM's are often installed with a large number of anchors, such as sod staples, stakes or percussion earth anchors, per unit area of mat. To facilitate the necessary contact, many TRMs are manually soil-infilled during installation, which is a time-consuming and labor intensive process.

U.S. Pat. No. 5,849,645 ("the '645 patent") discloses a reinforced composite matting for installation on a channel surface. The matting includes corrugated chambers formed by a very open netting structure. The chambers are in-filled with a fiber matrix that catches sediment from runoff passing through the channel which encourages seed germination and the establishment of root systems. While the fiber matrix can create a sediment entrapment effect, the fibers infilling the chambers actually take up space which could otherwise be available to accommodate more entrapped sediment. Further, the layers of composite matting in the '645 patent are stitched together with thread, limiting the overall strength of the mat and its resistance to layer separation when under high stress conditions. In addition, the reinforced composite matting of the '645 patent is secured in the channel with a large number of staples to anchor the netting to the underlying soil. Installing these anchors is time-consuming, labor intensive, and often does not accomplish sufficient continuous contact of the TRM to the underlying soil.

U.S. Pat. Nos. 5,567,087 and 5,616,399 to Theisen describe a single-layered, three dimensional soil protection mat produced from heat shrinkable monofilaments into a waffle or honeycomb pattern, with opposing adjacent pyramidal protrusions on each side of the mat. This structure provides only small diamond-shaped pockets for sediment entrapment within the mat, is not multi-layered and does not have a planar bottom layer to provide for increased sediment containment volume. Neither of the Theisen patents claim that the mats disclosed therein efficiently filter, trap and retain sufficient sediment to provoke self-anchoring of the mat.

Accordingly, a need exists for a TRM that is simpler to install and that can effectively filter, trap and retain sediment (soil/fine aggregate) carried in water flow to act as ballast and result in greater TRM-to-substrate contact with less need for the use of anchors and/or manual soil-infilling.

Furthermore, sediment control systems that include soil flocculating chemicals, degradable mats, and water clarification swales are now being used to clarify sediment-laden runoff water from construction sites. Sediment-laden runoff is directed into a swale or channel lined with a degradable mat typically made from jute or coconut fibers. The soil flocculants are administered at the upper portion of the swale or channel, causing small soil particles suspended in the water flow to aggregate and settle out on the surface of the degradable mat lining downstream. As these degradable mats are made from natural fibers and have no sediment entrapment chambers, they are limited in strength, sediment capacity and can only be used one time. Once sediment builds up on the mat surface, they are removed from the swale and discarded. Therefore, a need exists for a long-lasting, re-usable high strength sediment filtration mat that can be placed on the bottom of such clarification swales to more efficiently capture aggregated soil particles, with greater capacity to hold more sediment and sufficient strength to be lifted from the swale, washed clean of sediment, and re-used as desired.

SUMMARY OF THE INVENTION

In view of the foregoing, one object of the present invention is to provide a TRM or sediment filtration mat which overcomes the difficulties associated with holding such mats in continuous contact with the underlying soil surface and which provides improved sediment capturing performance. When used by itself herein and in the absence of any further clarifying description, the term "mat" shall refer to either a TRM or a sediment filtration mat.

Another object of the present invention is to provide a TRM that can more effectively filter, trap and retain sediment (soil/fine aggregate) carried in water flow to function as ballast to hold the TRM in continuous contact with the underlying substrate with less need for anchors.

Yet another object of the present invention is to provide a mat in accordance with the preceding object in which the mat structure itself functions as the filtration medium and does not rely upon fiber in-fill to perform the filtration.

A further object of the present invention is to provide a mat in accordance with the preceding objects that has a woven, non-woven or extruded bottom layer and a tightly woven or extruded corrugated body structure that are interwoven or continuously extruded together to form parabolic chambers which provide open areas within the mat to capture sediment.

A further object of the present invention is to provide a mat in accordance with the preceding objects that has a woven, non-woven or extruded bottom layer and a tightly woven or extruded corrugated body structure having variably sized openings, with larger openings on the sides facing the water flow and smaller openings on the leeward sides to allow for enhanced sediment entry into the chambers and subsequent entrapment of the sediment within the chambers, that together form parabolic chambers which provide open areas within the mat to capture sediment.

Yet a further object of the present invention is to provide a mat in accordance with the preceding objects that includes a woven or extruded top layer integrally secured to the corrugated body structure to form parabolic chambers on the top side of the mat which provide additional sediment retention capacity and protect captivated sediment from flow-induced shear forces by creating a shear plane along the upper boundary of the mat.

A still further object of the present invention is to provide a mat in accordance with the preceding objects in which the bottom layer is interwoven or continuously extruded with the lower surface of the corrugated body structure to provide a continuous three-dimensional structure.

Another object of the present invention is to provide a mat in accordance with the preceding objects in which the top layer is also interwoven or continuously extruded with the upper surface of the corrugated body structure to provide a continuous three-dimensional structure.

Yet another object of the present invention is to provide a mat in accordance with the preceding objects in which the interwoven or continuously extruded construction of the mat gives the mat high tensile strength and structural adjoinment to enable lifting and transport of the mat when soil-filled in order to clean and re-use the mat when used for sediment collection in water clarification projects.

Yet another object of the present invention is to provide a mat in accordance with the preceding objects in which the interwoven or continuously extruded construction of the mat gives the mat high tensile strength and structural adjoinment to instill increased damage resistance and prevent separation of layers and fiber loss in load bearing applications and under high stress conditions such as river banks with debris and ice flows.

Still another object of the present invention is to provide a mat in accordance with the preceding objects in which the mat has a woven, non-woven or extruded "closed mesh" bottom that will contain sediment within the mat and minimize or eliminate pass-through.

Yet a further object of the present invention is to provide a method of manufacturing a mat in accordance with the preceding objects by using heat shrinkable bottom and/or top layers and a non-shrinkable center layer to enable corrugation formation in the center layer through calendaring.

Still yet a further object of the present invention is to provide a mat in accordance with the preceding objects that is not complex in structure and which can be manufactured at low cost but yet efficiently traps sediment to make the mat self-anchoring and to keep the mat in contact with the underlying substrate, preventing gaps or spaces between the bottom layer and the underlying substrate so that water does not collect under the mat and cause erosion of the substrate.

In accordance with these and other objects, the present invention is directed to a mat having a tightly woven or extruded corrugated body structure integrally coupled with a woven or non-woven fabric bottom layer. The corrugated body structure may include variably sized openings, with larger openings on the sides facing the water flow and smaller openings on the leeward sides to allow for enhanced sediment entry into the chambers and entrapment within the chambers. Together, the corrugated body structure and bottom layer form parabolic chambers that filter and entrap sediment particles moving in water flow. Once caught in the corrugated body structure, the sediment particles are protected from further forces of water flow and remain trapped within the chambers.

The mat may optionally include a woven or extruded top layer integrally coupled to the top of the corrugated body structure. The top layer further protects the captivated sediment from flow-induced shear forces by creating a shear plane along the upper boundary of the mat. The top layer also forms additional parabolic chambers on the top side of the corrugated body structure for increased sediment retention capacity. With the parabolic chambers providing open areas within which significant amounts of sediment may be captured to provide a high degree of ballast action, the mat is self-anchoring, reducing cost and facilitating ease of installation.

The mat according to the present invention may also be used with polyacrylamides, chitosans or other soil flocculating/aggregating chemicals either incorporated into its woven structure during manufacture or otherwise spread into its structure during/after installation to facilitate aggregation of soil particles and more efficient sediment entrapment.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
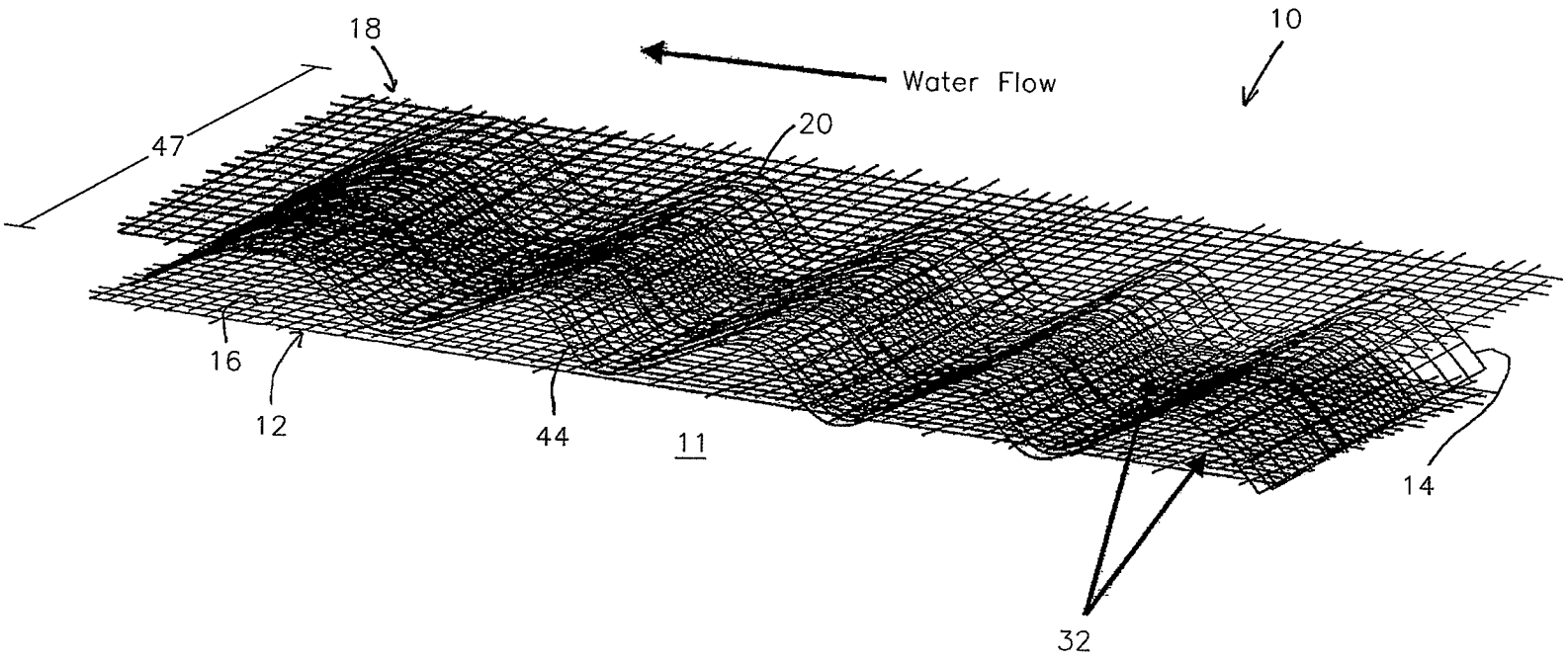
FIG. 1 is a perspective view of a mat having a corrugated body structure with top and bottom layers in accordance with the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
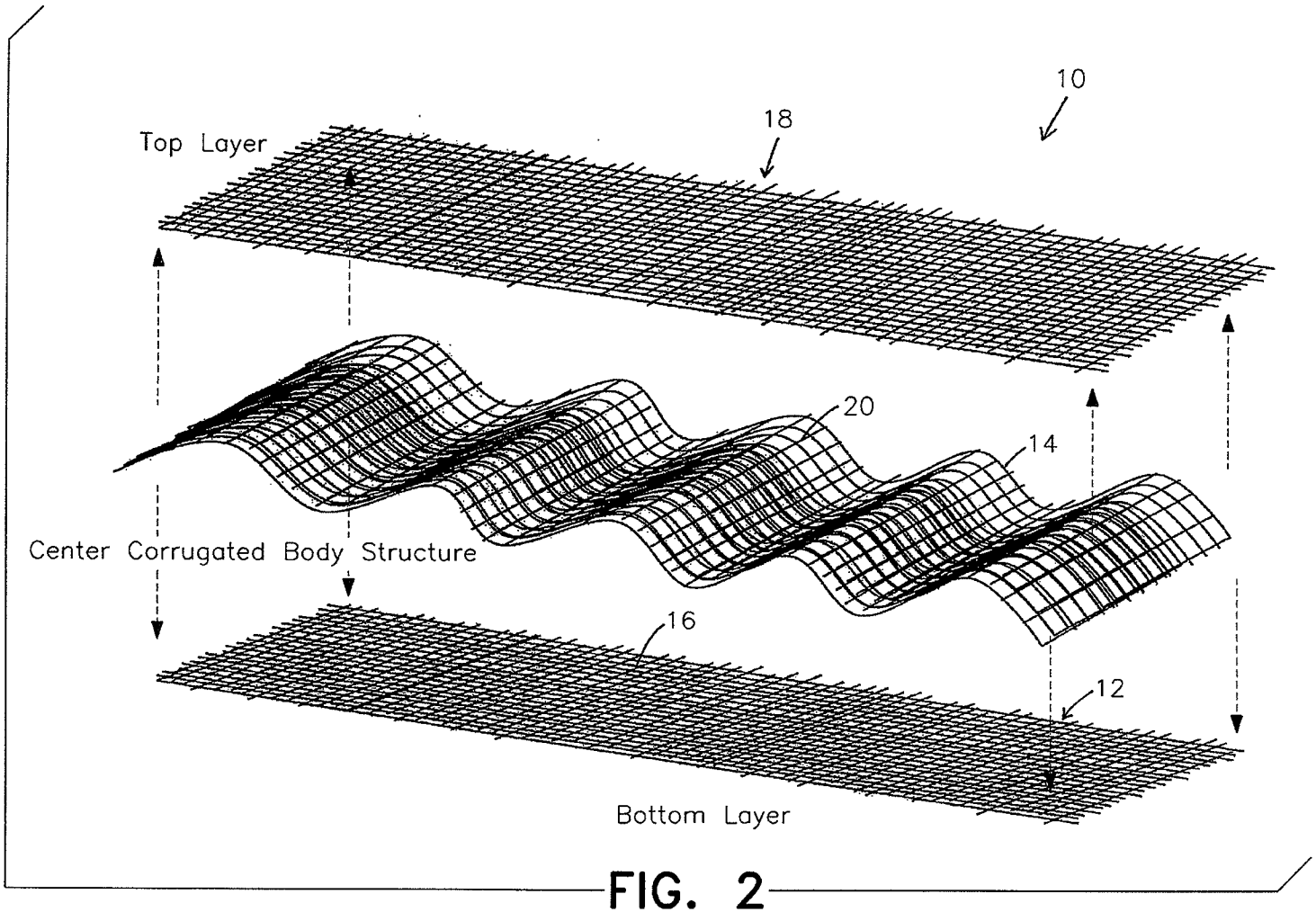
FIG. 2 is an exploded view of the layers and corrugated body structure shown in FIG. 1.
Figure 3:
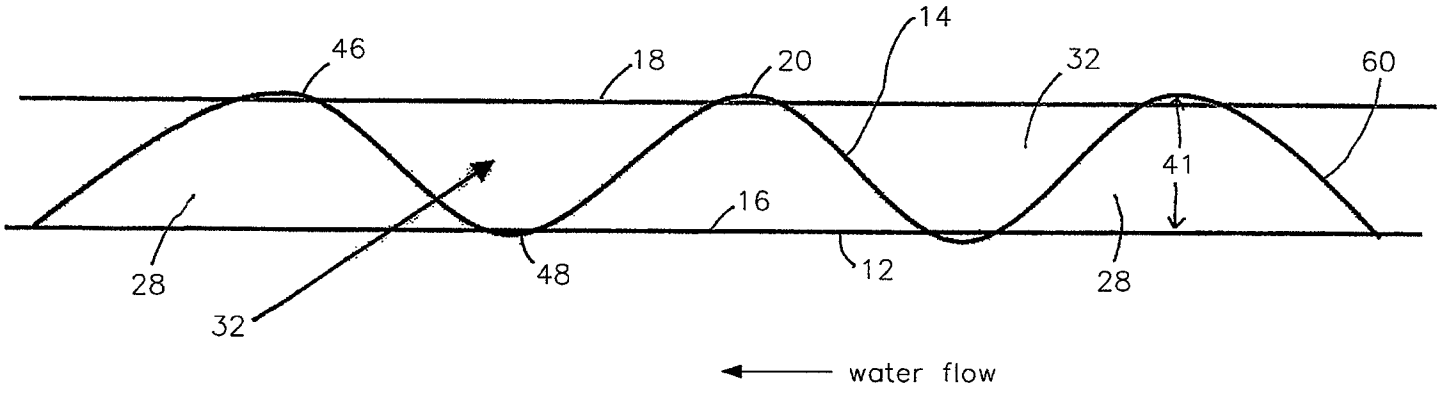
FIG. 3 is a side view of the corrugated body structure shown in FIG. 1.

As shown in FIGS. 1-3, the present invention is directed to a mat generally designated by reference numeral 10, placed on a soil area 11, subject to water flow indicated by arrow A. The mat 10 includes a woven, non-woven or extruded bottom layer generally designated by reference numeral 12, and a tightly woven or extruded corrugated body structure 14 secured to an upper surface 16 of the bottom layer 12. Optionally, the mat may further include a woven or extruded top layer generally designated by reference numeral 18, that is secured to the upper side 20 of the corrugated body structure 14. In one embodiment the bottom layer 12 and the corrugated body structure 14 are formed integrally with one another by continuous extrusion. In another embodiment, the bottom layer 12 and body structure 14 are interwoven together. In both cases, the result is a continuous three-dimensional structure.

The bottom layer may be a non-woven type fabric when the mat is used simply for sediment filtration, but the corrugated body and top layer (when used) should still be of woven or extruded mesh construction to provide ample mesh opening sizes for water and soil particles to flow into the parabolic entrapment chambers. When used as a TRM, it is typically preferred to have the bottom layer (as well as the corrugated body and top layer, when used) made of a woven or extruded mesh to allow for uninhibited vegetation growth through the mat. However, the mat preferably has a woven, non-woven or extruded "close mesh" bottom layer that will contain sediment entrapped within the mat and minimize or eliminate pass-through.

As best shown in FIG. 3, the corrugated body structure 14 is formed of a plurality of polymer strands 44 pleated into a plurality of alternating ridges 46 and troughs 48 extending in substantially parallel relation across the width 47 of the corrugated body structure 14. The top layer 18 is interwoven with the ridges 46 while the bottom layer 12 is interwoven with the troughs 48. The ridges 46 and troughs 48 are of a substantially uniform height 41, preferably from about 0.25 inches in height to about 4 inches in height, depending on the application. When used as a TRM, the height will typically be about 0.25 inches to about 1.0 inch. For reusable sediment filtration mats, the height may be from about 0.5 to about 4.0 inches for increased sediment containment volume. The ridges are spaced apart (ridge to ridge) in the length direction preferably from about 0.25 inches to about 8 inches with greater spacing for thicker mats. The ridges and troughs form a three-dimensional corrugated body structure 14 which serves to add strength and stability to the mat 10. The corrugated body structure 14 in combination with the bottom layer 12 forms a plurality of parabolic chambers 28 therebetween which serve to provide protected regions for filtering and trapping sediment.

Referring once again to FIG. 3, the top layer 18 is integrally secured on an upper side 20 of the corrugated body structure 14, adjacent to the ridges 46 of the corrugated body structure. The top layer 18 is interwoven with the ridges and bridges over the troughs 48 of the corrugated body structure 14 to form additional parabolic chambers 32 on the upper side of the corrugated body structure 14 to trap additional sediment therein. The top layer 18 also structurally supports the underlying corrugated body structure 14 to reduce stretching and flattening of the ridges 46 and troughs 48 during installation and prolonged use in its intended environment. Finally, the top layer 18 protects captivated sediment from flow-induced shear forces by creating a shear plane along the upper boundary of the mat.

Figure 5:
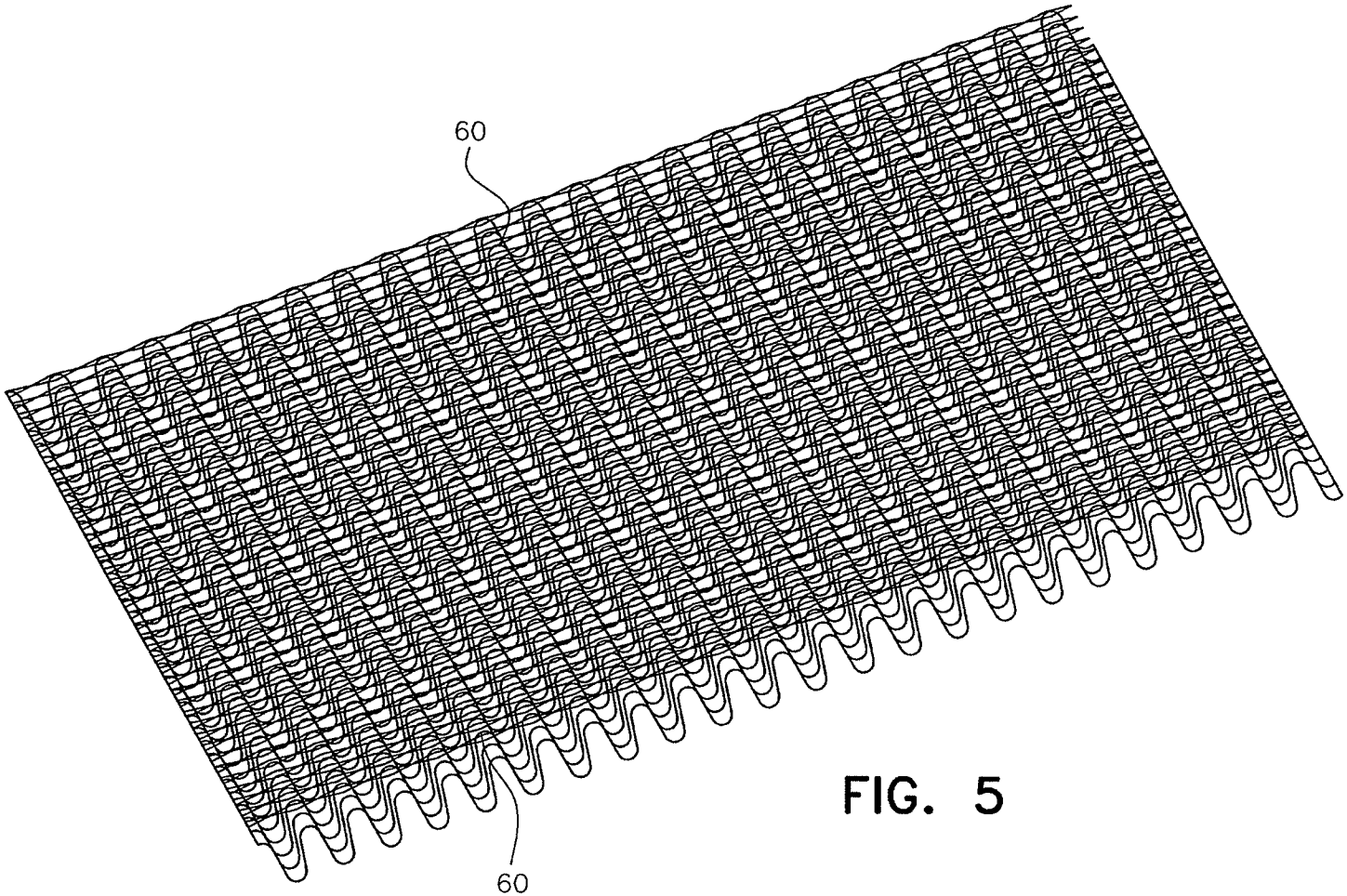
FIG. 5 shows a mat section made in accordance with the present invention.

According to an alternative configuration, the top layer may be embodied as a plurality of strands 60, preferably made of polypropylene or polyethylene, that run in the machine direction (MD) and are spaced from one another across the width of the mat (see FIG. 5). The MD strands act as reinforcing tendons and/or shrinker yarns to assist in formation of the corrugated center layer through calendaring as is discussed further hereinafter. The MD strands are interwoven with the ridges of the corrugated body structure to help maintain the corrugated shape of the body structure when the mat is subjected to tensile stress along the mat length. Accordingly, the top layer does not need to have transverse directional (TD) strands.

Figure 6:
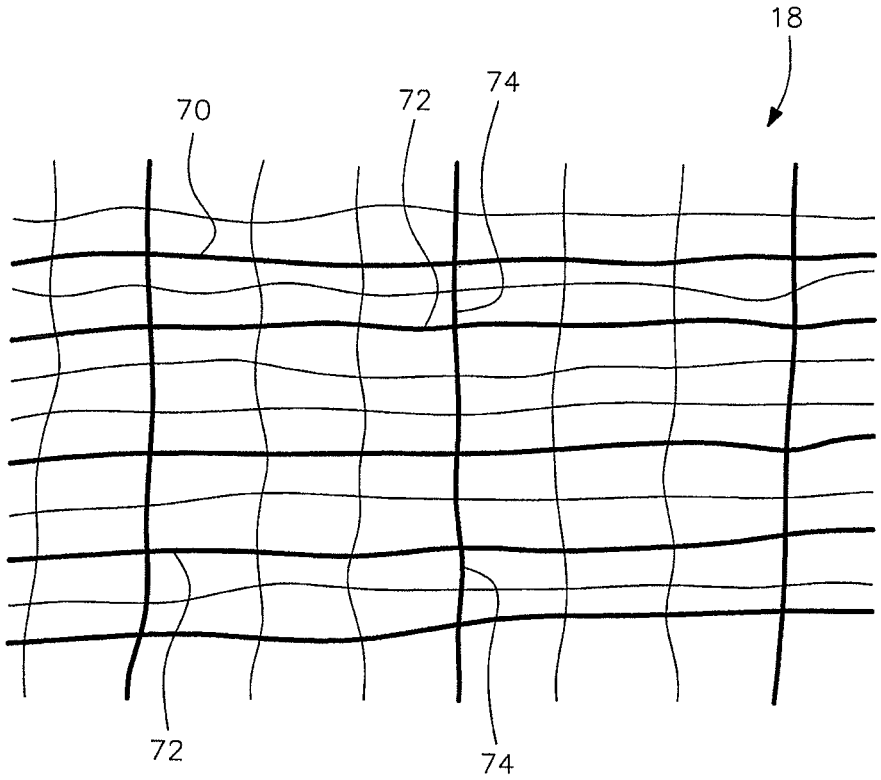
FIG. 6 is a top view of a mat in accordance with the present invention including reference markings on the upper surface to assist in mat alignment and anchor placement.

Whether constructed with only MD strands or with both MD strands and TD strands as in FIGS. 1-3, the mat may further be provided with brightly colored yarns running in the MD about four to six inches from the edge of the mat (see FIG. 6). These brightly colored yarns function as visual reference lines for aligning adjacent overlap seams when the mats are being installed.

In addition, brightly colored yarns may also be used at specific intervals in the MD and/or the TD to function as visual reference lines or marks for other purposes (see FIG. 6). For example, the top layer may be marked with brightly colored yarns in both the MD and the TD which, at their points of intersection, provide visual reference markings for desired placement of anchors that may be used to secure the mat to the underlying surface.

While the bottom layer 12, the corrugated body structure 14 and the top layer 18 may be secured together using various methods, an interwoven or continuously extruded construction is preferred to ensure that the reinforced composite matting 10 stays together during storage, installation and prolonged use in its intended environment.

According to a preferred embodiment, the bottom and/or top layers are preferably interwoven with the corrugated body structure in a manner like that of stacking three window screens on top of each other with the strands forming each screen interwoven together, and with the center screen being corrugated. The middle screen, with corrugations positioned perpendicular to water flow, will filter out and capture sediment in the parabolic chambers as it passes through the screen face 60, as shown in FIG. 3. Interweaving of the top and bottom layers with the corrugated body structure creates a durable, damage resistant mat for load bearing, high stress erosion control applications, such as areas with vehicular traffic and rivers carrying large amounts of debris and/or ice flows.

The corrugated body is typically formed of high-strength, UV stabilized and chemically resistant woven monofilament fabric or fine mesh extruded netting to function as long-lasting sediment filtration and entrapment media. The bottom layer may be a similar woven fabric, non-woven fabric, or fine mesh extruded netting. The top layer may be a similar woven fabric or fine mesh netting. According to the present invention, the mat structure itself functions as the filtration medium and does not rely upon fiber in-fill to perform the filtration.

To create the corrugated body, this structure may be comprised of relatively stiff monofilaments to provide compression resistance and the use of heat shrinkable bottom and/top layers and non-shrinkable center layer (which forms the corrugated body structure) to enable corrugation formation through calendaring. Calendaring occurs when the woven mat is heated to cause the bottom/top layers to shrink while there is no shrinkage in the center net, which thereby creates the corrugation in the center net. As noted earlier, rather than having a full top layer, strands 60 running only in the machine direction and spaced from one another across the width of the mat may be made of shrinker yarns to assist in the formation of the corrugated center layer (see FIG. 5). Shrinker yarns as used herein refer to yarns made of a material that shrinks at a lower temperature than the material from which the body structure is made, causing the body structure to draw in and form corrugations in the body layer.

The UV stability of the mat should demonstrate a minimum 80% tensile retention at 1,000 hours when subjected to ASTM D4355 testing protocol. The polymer/s comprising the mat should have a specific gravity of at least about 0.90 and may preferably be higher density polyester, nylon, other synthetic material or a blend, with specific gravities from about 1.0 to about 2.5 to achieve negative buoyancy. The mat preferably has a thickness of at least about 0.25 inches, with a thickness of between about 0.25 inches and about 0.5 inches being preferred for TRM applications, and about 0.5 inches to about 4.0 inches preferred for reusable sediment filtration applications (measured with ASTM D6525). The stiffness of each layer is preferably from about 0.2 in-lbs to about 0.5 in-lbs, with overall stiffness from about 0.4 in-lbs to about 1.5 in-lbs (ASTM D1388).

The tensile strength of the mat is at least about 1,500 lbs/ft×1,500 lbs/ft, with about 3,000 lbs/ft×3,000 lbs/ft or greater (ASTM D6818) being preferred. The mats according to the present invention inherently have high tensile strength and structural adjoinment to enable lifting and transport of the mat when soil-filled in order to clean and re-use the mat when used for sediment collection in water clarification projects, for example. Also, high tensile strength increases the mat's damage resistance and load bearing capacity when used in areas subject to vehicular traffic or debris or ice flows.

The top layer 18, bottom layer 12 and corrugated body 14 each have an approximate weight of between about 3 and 8 oz per square yard. The weight may be greater for the corrugated body in thick mats used for sediment filtration, i.e., possibly as high as about 32 oz per square yard.

Figure 4:
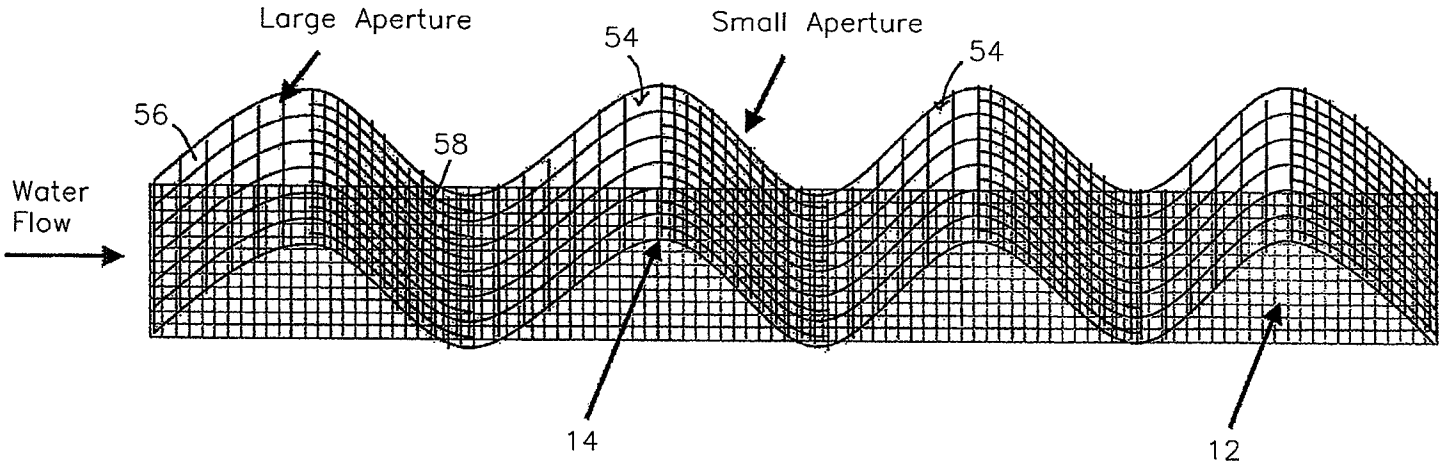
FIG. 4 is a perspective view of a mat having a bottom layer interwoven with the troughs of the corrugated body structure.

As shown in FIG. 4 which does not include a top layer, the tightly woven monofilament strands of the corrugated body structure 14 and the bottom layer 12 form a plurality of apertures generally designated by reference numeral 54 between the woven monofilaments. The apertures 54 are preferably of a substantially rectangular configuration, although other aperture shapes, such as diamond apertures, are intended to fall within the scope of this disclosure. The apertures are formed by the strands which are preferably woven in a substantially uniform spacing selected from about 0.0625 inches to about 0.25 inches in length, and from about 0.0625 inches to about 0.25 inches in width. The apertures may be variably sized, with larger openings 56 on the sides facing the water flow and smaller openings 58 on the leeward sides to allow for enhanced sediment entry into the chambers and entrapment within the chambers. The sizes of the apertures in each layer may also be adjusted to customize filtration capabilities for different soil types (finer mesh for smaller particle sizes). With the woven mesh construction, a relatively tight weave may be used in the bottom layer resting against the soil to maximize erosion protection, while a more open weave may be used in the corrugated body structure and top layer (when used) to allow unimpeded vegetation growth through the mat.

A representative section of a mat in accordance with the present invention, and identified as the VMAX® W3000 high performance turf reinforcement mat ("VMAX® W3000 mat") is shown in FIG. 5. As may be seen, the mat has a top layer formed of only MD strands 60 and a bottom layer, with each layer being interwoven with a respective opposing side of the corrugated body structure.

The VMAX® W3000 mat shown in FIG. 5 is a machine-produced mat of 100% UV stabilized high denier polypropylene and polyethylene strands woven into a permanent, high strength three-dimensional turf reinforcement matting. As used herein, "permanent" means that the mat has an expected functional longevity of more than three years in typical field applications. The top layer includes a plurality of polyethylene strands spanning the entire machine direction (MD) which function as reinforcing tendons and shrinker yarns, while the woven bottom layer is integrally interlaced into the woven corrugated body structure. In addition to effectively controlling erosion and reinforcing vegetation against high flow induced shear forces, the VMAX® W3000 mat provides a highly frictional surface to prevent sod slippage when sod is installed over the mat.

As constructed according to one embodiment, the VMAX® W3000 mat exhibits approximately 80% resiliency (test method ASTM 6524), approximately 60% elongation (MD) (test method ASTM D6818), approximately 50% elongation in the transverse direction (TD) (test method ASTM D6818), and has a tensile strength in both MD and TD of about 3,300 lbs/ft (48 kN/m) (test method ASTM D6818). The UV stability of the VMAX® W3000 mat is greater than about 80% at 3000 hours (test method ASTM D4355), and light penetration is about 10% (test method ASTM D6567). While other thicknesses may be used, the VMAX® W3000 mat is preferably about 0.25 inches (6.4 mm) thick (test method ASTM D6525), and has a mass per unit area of about 11 oz/yd$^2$ (373 g/m$^2$) (test method ASTM 6566) so that a mat roll with a width of 11.5 feet (3.5 m) and a length of 90 feet (27.4 m) weighs +/−79 lbs (35.8 kg). A roll with these dimensions will cover an area of about 115 square yards or 96 square meters.

As constructed according to a second embodiment, the VMAX® W3000 mat exhibits approximately 98% resiliency (test method ASTM 6524), approximately 35% elongation (MD) (test method ASTM D6818), approximately 20% elongation in the transverse direction (TD) (test method ASTM D6818), has a tensile strength in the TD of about 3,800 lbs/ft (55.5 kN/m) (test method ASTM D6818) and has a tensile strength in the MD of about 3,600 lbs/ft (52.6 kN/m) (test method ASTM D6818). The UV stability of the VMAX® W3000 mat is greater than about 80% at 3000 hours (test method ASTM D4355), and light penetration is about 12% (test method ASTM D6567). While other thicknesses may be used, the VMAX® W3000 mat according to the second embodiment is preferably about 0.40 inches (10.2 mm) thick (test method ASTM D6525), and has a mass per unit area of about 14.7 oz/yd$^2$ (495 g/m$^2$) (test method ASTM 6566) so that a mat roll with a width of 10.0 feet (3.05 m) and a length of 90 feet (27.4 m) weighs +/−90 lbs (41.0 kg). A roll with these dimensions will cover an area of about 100 square yards or 83.6 square meters.

Figure 7:
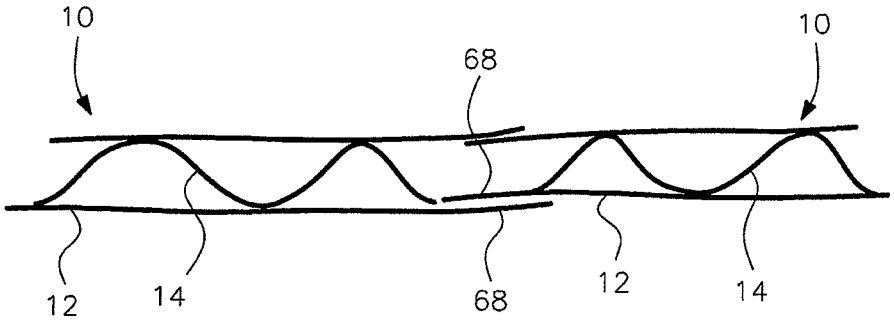
FIG. 7 is a side view of two adjoining mats with flat layers on their edges that provide an overlap seam.

Mats according to the present invention are preferably formed in rolls having a width of between about 6 and 16 feet, and a length of between about 50 and 200 feet. When used as a reusable sediment filtration mat, roll widths of from 4 feet to 8 feet are preferred, and shorter roll lengths of 10 feet to 25 feet are desired to enable rolling and lifting the sediment-filled mat. As shown in FIG. 7, the roll edges preferably have flat layers 68 on the outside edges (4-6 inches) to provide an overlap seam for tying together adjacent mat sections. As noted previously herein and shown in FIG. 6, the mat preferably has brightly colored yarns 70 running in the machine direction about 4-6 inches from each roll edge to function as visual reference lines for aligning adjacent overlap seams. Brightly colored yarns 72, 74 may also be used at specific intervals in both the MD and the TD to provide visual reference lines or marks for anchor placement.

The TRM is easily installed by unrolling the desired number of sections over a seeded soil surface in the direction of expected primary water flow, anchoring the TRMs in terminal trenches along all edges, and seaming adjacent mats together with desired type(s) of anchors. The mats may also be installed by unrolling the desired number of sections over a bare soil surface, and then broadcasting or hydraulically applying seed, and in some cases mulch, into the mat. In areas where water flow carries minimal sediment load, the mat structure may be manually in-filled with soil to provide immediate ballast effect and a growth medium for seed.

Reusable sediment filtration mats are installed in a similar manner, but no seed is applied to the soil surface and terminal trenches are not used. Temporary anchors may be used to keep the mat in place before becoming sediment laden.

The ridges 46 and troughs 48 of the corrugated body structure 14 when installed are intended to be substantially perpendicular to the intended direction of water flow as shown in FIG. 1. This orientation helps the corrugated body structure 14 to act as a filtration media and trap sediment in the parabolic chambers 28, 32 between the ridges 46 and troughs 48, and reduces the washing away of the trapped sediment during high velocity channel flow. The corrugated body structure 14 is not in-filled with any fiber or other material, leaving the parabolic chambers 28, 32 open to be able to accommodate the greatest amount of sediment.

While the force of a water flow moves sediment particles through openings in the tightly woven or extruded corrugated body structure, once the sediment particles have entered the parabolic chambers, the tightly woven or extruded construction of the mat protects the sediment particles from further forces of water flow, trapping the sediment particles within the chambers between the bottom layer and the corrugated body structure. This collection and retention of particles may be facilitated by providing the corrugated body structure with variably sized openings, with larger openings on the sides facing the water flow and smaller openings on the leeward sides to allow for enhanced sediment entry into the chambers and entrapment within the chambers. The sediment then acts as ballast to hold the mat firmly against the underlying substrate. As noted earlier, terminal trenches and anchors along adjacent roll seams may also be used.

The mat of the present invention is particularly suited to installation in areas in which expected water flows will be carrying some sediments, such as new drainage channels, lakes and stream banks, and steep slopes with sediment-laden runoff. In areas where water flow carries minimal sediment load, the mat structure may be manually in-filled with soil to provide immediate ballast effect and a growth medium for seed.

As described herein, the mat according to the present invention is designed to provide sufficient thickness, optimum open area and three-dimensionality for effective erosion control and vegetation reinforcement against high flow induced shear forces. The mat has high tensile strength for excellent damage resistance and for increasing the bearing capacity of vegetated soils subject to heavy loads from maintenance equipment and other vehicular traffic. The corrugated structure provides a highly frictional surface to prevent sod slippage when sod is installed over the mat. When used as surface protection without sod overlay, the corrugated structure functions as a filtration medium to trap and retain sediment in water flow and promote self soil-filling of the mat body.

As disclosed herein, the mat according to the present invention may be used for erosion control/turf reinforcement applications and also, due to its enhanced sediment filtration/containment capabilities, the mat may also be used as a reusable sediment filtration mat. Furthermore, this mat has inherently much higher tensile strength and structural adjoinment of the two/three layers than do conventional stitched or laminated TRM's to enable lifting and transport of the soil-filled mat for cleaning and re-use when the mat is used for sediment collection in water clarification projects. The increased tensile strength and adjoinment of layers also enables the mat to be used effectively in load bearing applications and in areas exposed to debris and ice flows.

The foregoing descriptions and figures should be considered as illustrative only of the principles of the invention. The invention may be configured in a variety of shapes and sizes and is not limited by the dimensions of the preferred embodiment. Numerous applications of the present invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

What is claimed is:

1. A mat for protecting one or more of channels, lake shorelines, stream banks and steep slopes, and for filtering and collecting soil sediment from runoff water, said mat comprising:

a tightly woven or extruded, three dimensional corrugated body structure wherein the corrugated body structure comprises sides facing toward a direction of expected water flow and sides facing away from the direction of expected water flow, and a bottom layer secured to a lower side of said corrugated body structure, said corrugated body structure with said bottom layer secured thereto forming a plurality of sediment entrapment chambers that create continuous open areas across a width of the mat that are unobstructed by a filling material and are configured to filter, capture and retain sediment, wherein the corrugated body comprises openings, and further wherein the openings on the sides facing the direction of expected water flow are larger relative to the openings on the sides facing away from the direction of expected water flow, thereby allowing enhanced sediment entry into the plurality of sediment entrapment chambers and entrapment within the plurality of sediment entrapment chambers; and wherein openings in the bottom layer are smaller than openings in the corrugated body structure to provide enhanced erosion control and customized filtration capabilities dependent on soil type as well as to allow uninhibited vegetation growth through the mat.

2. The mat as set forth in claim 1, wherein the bottom layer and the corrugated body structure are interwoven.

3. The mat as set forth in claim 1, wherein the bottom layer and the corrugated body structure are continuously extruded to form an integral mat structure.

4. The mat as set forth in claim 1, further comprising a top layer interwoven or integrally secured to an upper side of said corrugated body structure, said corrugated body structure with said top layer secured thereto forming an upper plurality of sediment entrapment chambers that create additional continuous open areas across the width of the mat that are unobstructed by a filling material and configured to filter, capture and retain additional sediment.

5. The mat as set forth in claim 1, wherein said corrugated body structure has a thickness of between about 0.25 inches and about 0.5 inches.

6. The mat as set forth in claim 1, wherein said corrugated body structure has a thickness of between about 0.5 inches and about 4.0 inches.

7. The mat as set forth in claim 1, wherein a volume of said open areas within the lower sediment entrapment chambers is about 162 cubic inches per square yard in a mat that is about 0.25 inches thick.

8. The mat as set forth in claim 1, wherein a volume of said open areas within the lower sediment entrapment chambers is about 2,592 cubic inches per square yard in a mat that is about 4 inches thick.

9. The mat as set forth in claim 4, wherein a volume of said lower and upper sediment entrapment chambers is about 324 cubic inches per square yard in a mat that is about 0.25 inches thick.

10. The mat as set forth in claim 4, wherein a volume of said lower and upper sediment entrapment chambers is about 5,184 cubic inches per square yard in a mat that is about 4 inches thick.

11. The mat as set forth in claim 1, wherein said mat includes brightly colored marker lines running in a machine direction for seam alignment with one or more of adjoining mats and anchor placement.

12. The mat as set forth in claim 4, wherein said mat includes brightly colored marker lines running in a machine direction for seam alignment with one or more of adjoining mats and anchor placement.

13. The mat as set forth in claim 1, wherein said mat includes brightly colored marker lines running in both machine and transverse directions, intersections of said marker lines indicating locations for anchor placement.

14. The mat as set forth in claim 4, wherein said mat includes brightly colored marker lines running in both machine and transverse directions, intersections of said marker lines indicating locations for anchor placement.

15. The mat as set forth in claim 1, wherein the mat is self-anchoring.

16. The mat as set forth in claim 1, used in conjunction with soil flocculants applied during one or more of mat manufacture, mat installation, or after mat installation to increase sediment aggregation and deposition within the mat.

17. The mat as set forth in claim 1, wherein said mat is a turf reinforcement mat.

18. The mat as set forth in claim 1, wherein said mat is a reusable sediment filtration mat.

* * * * *